US010273844B2

(12) United States Patent
Sheridan

(10) Patent No.: US 10,273,844 B2
(45) Date of Patent: Apr. 30, 2019

(54) MUFFLER

(71) Applicant: Matt Sheridan, Midland, MI (US)

(72) Inventor: Matt Sheridan, Midland, MI (US)

( * ) Notice: Subject to any disclaimer, the term of this patent is extended or adjusted under 35 U.S.C. 154(b) by 127 days.

(21) Appl. No.: 15/456,756

(22) Filed: Mar. 13, 2017

(65) Prior Publication Data

US 2018/0258807 A1 Sep. 13, 2018

(51) Int. Cl.
*F01N 1/08* (2006.01)
*F01N 1/12* (2006.01)

(52) U.S. Cl.
CPC ..... *F01N 1/083* (2013.01); *F01N 2240/20* (2013.01); *F01N 2530/04* (2013.01); *F01N 2530/06* (2013.01)

(58) Field of Classification Search
CPC ..... F01N 1/083; F01N 1/086; F01N 1/12
USPC ..... 181/264, 279, 280
See application file for complete search history.

(56) References Cited

U.S. PATENT DOCUMENTS 1,474,115 A * 11/1923 Heather ..... F01N 1/083 181/281
1,804,070 A * 5/1931 Sykes ..... F01N 1/083 181/264
2,651,381 A * 9/1953 Cooper ..... F01N 1/083 181/281
3,235,003 A * 2/1966 Smith ..... F01N 1/125 138/38
3,811,531 A * 5/1974 Forssman ..... F01N 1/082 181/258
4,027,740 A * 6/1977 Martin ..... F01N 1/083 181/281
7,793,758 B2 * 9/2010 Rinnback ..... F01N 1/02 181/247
8,614,424 B2 * 12/2013 Mondt ..... C02F 1/325 250/437
2005/0205353 A1 * 9/2005 Chen ..... F01N 1/086 181/270

* cited by examiner

*Primary Examiner* — Jeremy A Luks

(57) ABSTRACT

A muffler that uses baffles at a 45° relative to one another to create a helical configuration within the cylindrical housing allowing exhaust gases to pass more freely than the prior art mufflers, while maintaining superior noise reduction.

5 Claims, 6 Drawing Sheets

MUFFLER

BACKGROUND OF THE INVENTION

The present invention is a muffler. Mufflers are not new to the art. However, a muffler that does not effectively block exhaust gases as they enter and exit the muffler is. Most mufflers force the exhaust gases to pass baffles that approach or exceed a 90° angle to pass through the muffler. The present invention does not. The plates or baffles are arranged in a manner that the next plate is oriented in a 45° angle in relation to an adjacent plate.

The present invent ion has an enlarged muffle tube and the plates are oriented in a 45° angle relative to each other. The size of the muffler is dependent on the exhaust diameter of the vehicle and the width of the plates. The arrangement of the plates is helical relative to each other and as gases pass through the exhaust they spiral. These gases pass straight through the exhaust and only one plate is impacting the gas at any single moment.

The plates are arranged so that when looking through yon cannot see through to the other end of the muffler. It has been discovered that this allows the gases to move through the muffler more rapidly while still providing sufficient noise reduction.

THE INVENTION

The present invention is a muffler. The muffler comprises a cylindrical housing that has a first end, a second end, a predetermined length, a predetermined diameter, and a long axis.

Contained within the cylindrical housing is a plurality of baffles. The baffles are comprised of a first baffle located near the first end. The first baffle is oriented such that the first end near end meets the top of the cylindrical housing and a distal end of the first end meets a bottom of the cylindrical housing.

There is at least one second baffle separated at a predetermined distance from the first baffle. The second baffle is oriented 45° from the first baffle. There is at least one additional baffle, separated at a predetermined distance from the second baffle. The one additional baffle is oriented 45° angle from the second baffle. Therefore, any baffle located a predetermined distance from at least one additional baffle is oriented at a 45° angle from an adjacent baffle.

The baffles are aligned such that they form a helix configuration within the cylindrical housing. Each baffle has a length in one direction equivalent to the diameter of the cylindrical housing and a width in a perpendicular direction to the length that is one-half of the diameter of the cylindrical housing. This muffler is manufactured from metal. This muffler of the metal is manufactured of steel or aluminum. This muffler can be manufactured wherein the cylindrical housing contains 7 baffles on average.

DERAILED DESCRIPTION OF THE DRAWINGS

Figure 1:
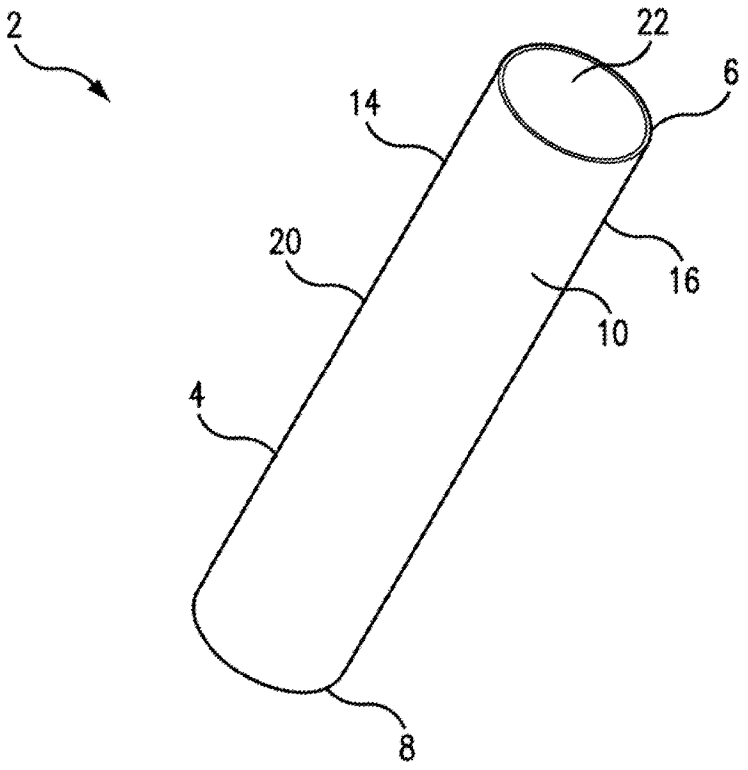
FIG. 1 is a view in perspective of the muffler from the side.

FIG. 1 shows the cylindrical housing 4 of the muffler 2 from the side 36. The baffles or plates 12 (shown in FIG. 2) are oriented in a 45° angle to an adjacent plate 12. The muffler 2 has a cylindrical housing 4 that has a first end 6 and a second end 8. This cylindrical housing 4 has a predetermined length. The cylindrical housing 4 of the muffler 2 also has a predetermined diameter. This predetermined diameter is dependent on the needs of each specific vehicle. The cylindrical housing 4 also has a long axis 10. The cylindrical housing 4 has a top 14 and a bottom 16. The cylindrical housing 4 has an outside surface 20 and an inside surface 22. It has been discovered that the present invention produces less noise, is less expensive, more durably and will not trap water that is created as a result of the internal combustion process.

Figure 2:
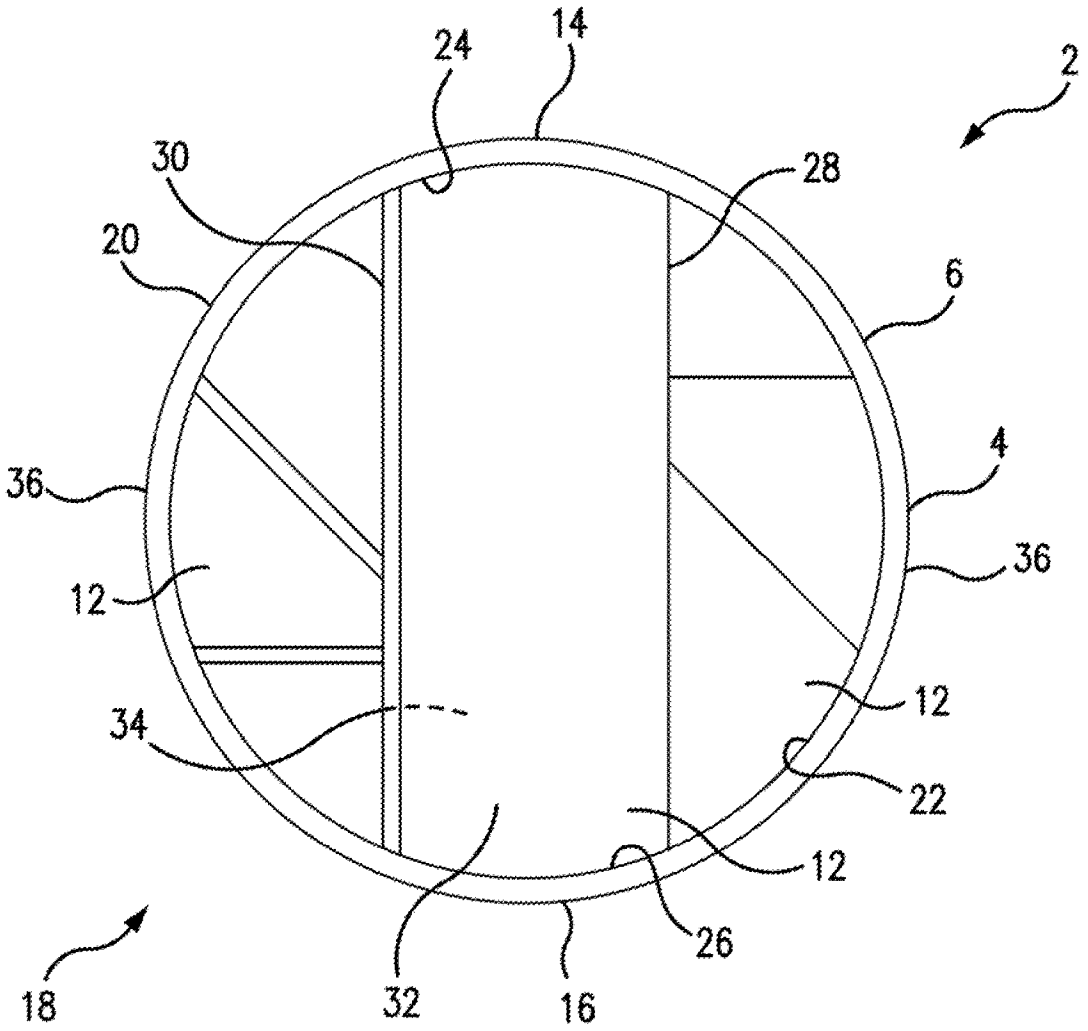
FIG. 2 is an illustration of the muffler from the first end.

FIG. 2 shows the muffler 2 from the first end 6. There are three baffles 12 present making the beginning of the helical configuration 18. Each baffle 12 is oriented 45° angle to an adjacent baffle 12. Also shown is the top 6 of the cylindrical housing 4. The bottom 16 is also shown. The outside surface 20 and the inside surface 22 are also clear.

The baffle 12 has a top edge 24 that is attached to the inside surface 22 at the top 14 of the cylindrical housing 4. The baffle 12 has a bottom edge 26 that is attached to the inside surface 22 at the bottom 16 of the cylindrical housing 4. This first baffle 12 has a first surface 32 and a second surface 34.

The second baffle 12 also has a top edge 24 that is attached between the top 14 and the side 36 at the cylindrical housing 4 inside surface 22. The bottom edge 26 of the baffle 12 is attached between the side 36 and the bottom 16 of the cylindrical housing 4. This baffle is oriented at a 45° angle in relation to the first baffle 12.

The third baffle 12, and any subsequent baffles, also have a top edge 24 that is attached at the side 36 of the cylindrical housing 4. The bottom edge 26 of the baffle 12 is also attached to the side 36. This third baffle 12 is oriented at a 45° angle to the second baffle 12. This progression of 45° orientation to the adjacent baffle 12 gives the helical configuration to the baffle 12 arrangement. Any additional baffles are arranged in the same manner.

Figure 3:
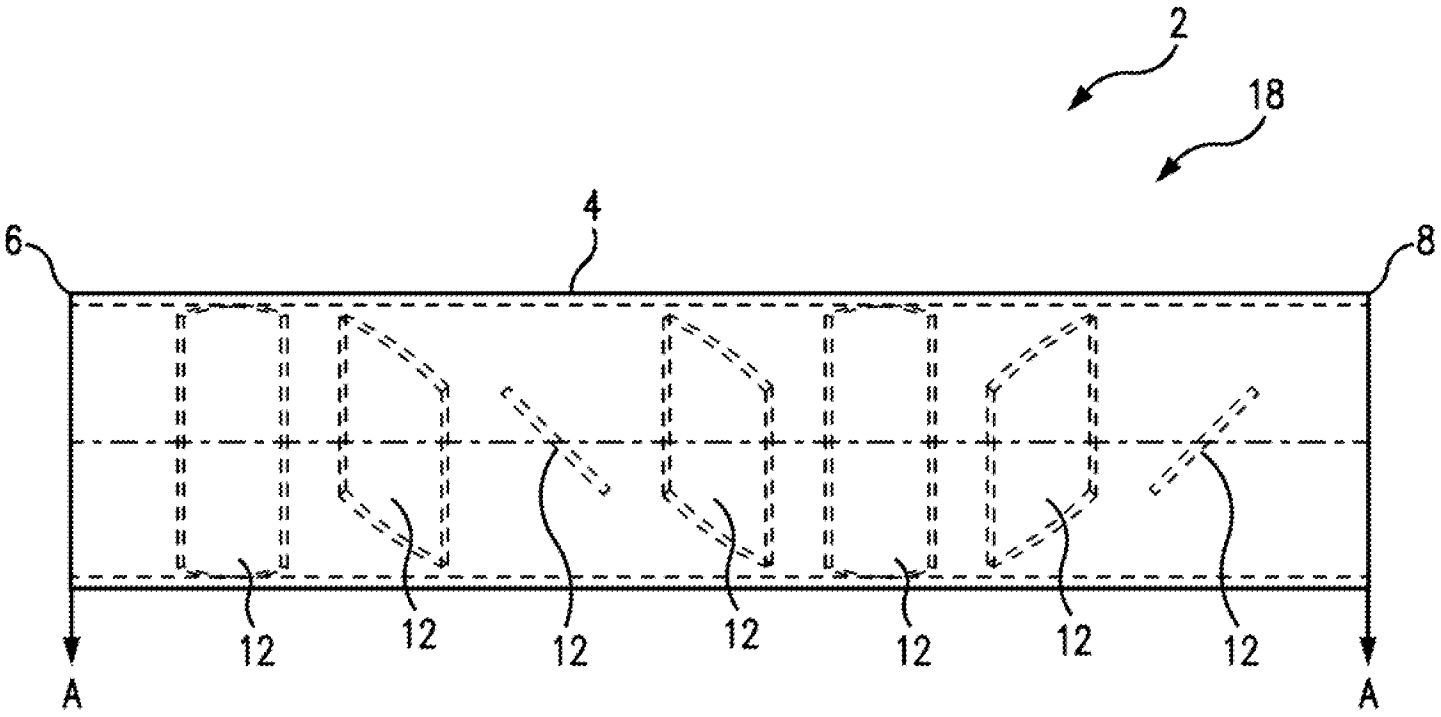
FIG. 3 is an illustration of the muffler with the baffles in phantom along line A-A.

FIG. 3 shows the muffler 2 with the baffles 12 in phantom along line A-A. The cylindrical housing 4 has a first end 6 and a second end 8. The baffles 12 are in phantom and arranged in a helical configuration 18.

Figure 4:
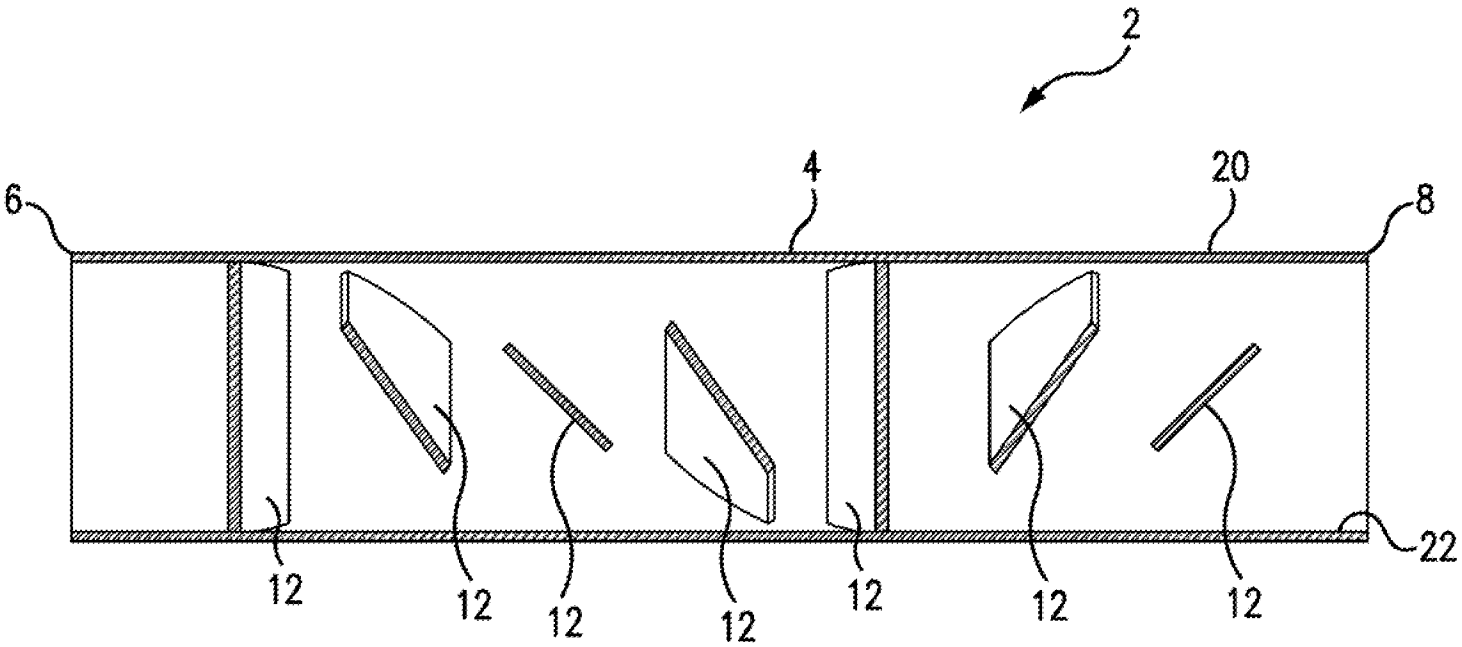
FIG. 4 shows the muffler section along line A-A of FIG. 3.

FIG. 4 shows the muffler 2 section along line A-A. This shows the baffles 12 arranged in the helical configuration where the baffles 12 are aligned at a 45° angle to the previous baffle. Once again forming the helical configuration that allows the exhaust gas to pass through the muffler 2 without being diverted at a 90° angle as prior art mufflers do. This is the essence of the invention in that the prior art mufflers block the exhaust flow and divert it into a sharp angle. In the instant invention, the gas passes each baffle and forces the gas into a spiral movement not blocking the gas flow. The result is a much more efficient muffler. The open baffle system also provides no trapping area within the muffler 2 preventing a build of a condensation. Condensation prevents proper gas flow and it also increases the development of rust and muffler rot shortening the life span of the muffler.

Figure 5:
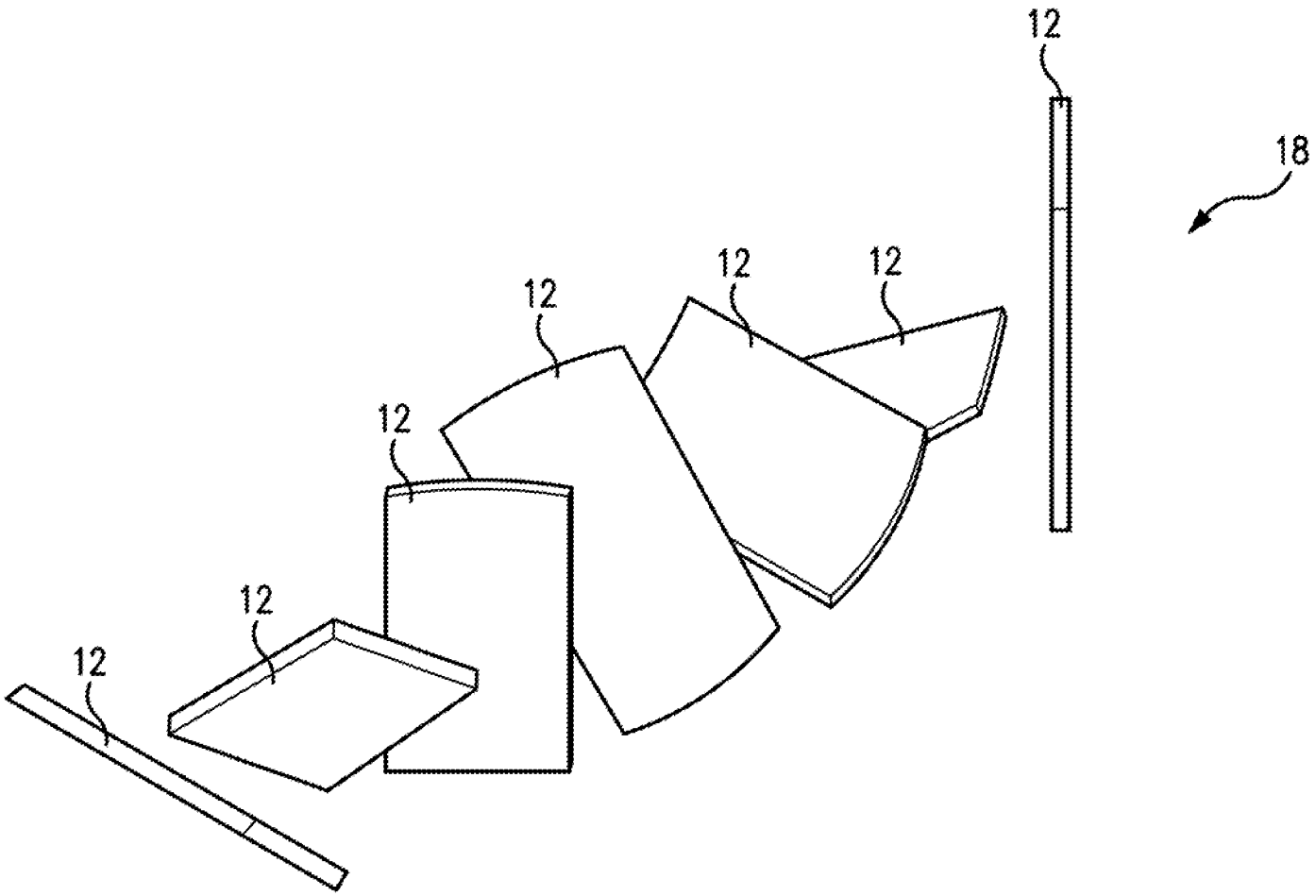
FIG. 5 illustrates the muffler baffle orientation.

FIG. 5 shows the muffler 2 baffle 12 orientation. The baffle/plate 12 orientation is key to the inventions utility because it has been discovered that this allows the gases to move through the muffler more rapidly while still providing sufficient noise reduction. This shows the path the gas takes through and around the baffles 12 that induces the helical flow of the exhaust gas.

The distance between the baffles is within a range of 0.5 to 3.75 inches. It is more preferable that the range between the baffles is 1.25 and 3 inches. It is most preferable that the distances between the baffles is 2.25 inches.

The baffles are attached such that there are no gaps at the end of the baffles and the round configuration of the muffler (FIG. 3). This design allows for a gas flow rate of up to 1300 to 1400 CFM.

The length of the muffler is 12 inches to 30 inches with a diameter of 3 to 18 inches being preferred.

The baffles are oriented so there is no direct line of sight through the muffler from one end to the other. The best orientation of baffles is seven within the muffler.

Figure 6:
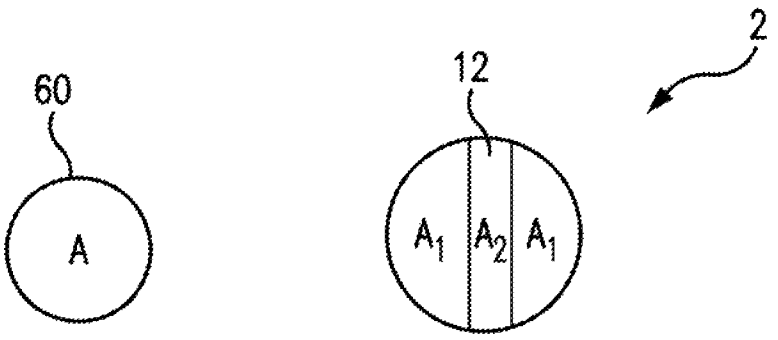
FIG. 6 shows the baffle size equation.

FIG. 6 shows the baffle size equation.

The area of the muffler is $\pi R^2$ (pi R Squared). The Area A is the area of the incoming exhaust pipe 60 which is equal to the area $A_1$-$A_2$. Therefore, the area equitation is $A=A_1-A_2$. This is the determining factor in the size of the baffles for each size pipe that the muffler 2 is comprised of.

What is claimed is:

1. A muffler, said muffler comprising:

a. a cylindrical housing having a first end, a second end, a predetermined length, a predetermined diameter, and a long axis;

b. contained within said cylindrical housing a plurality of flat baffles, said flat baffles comprising a first flat baffle located near said first end, c. said first flat baffle being oriented such that a near end of said first end meets a top of said cylindrical housing and a distal end of said first end meets a bottom of said cylindrical housing;

d. at least one second flat baffle separated a predetermined distance from said first flat baffle, said second flat baffle being oriented 45° from said first flat baffle;

e. at least one additional flat baffle, separated a predetermined distance from said second flat baffle, said one additional flat baffle being oriented 45° angle from said second flat baffle;

f. any flat baffle located a predetermined distance from said at least one additional flat baffle being oriented 45° angle from a preceding flat baffle;

g. said flat baffles being aligned such that they form a helix configuration within said cylindrical housing, each said flat baffle having a length in one direction equivalent to said diameter of said cylindrical housing and a width in a perpendicular direction to the length that is one-half of said diameter of said cylindrical housing.

2. A muffler as claimed in claim 1 that is manufactured from metal.

3. A muffler as claimed in claim 2 wherein the metal is steel.

4. A muffler as claimed in claim 2 wherein the metal is aluminum.

5. A muffler as claimed in claim 1 wherein the cylindrical housing contains 7 flat baffles.

* * * * *